US006908113B2

(12) United States Patent
Chaduc et al.

(10) Patent No.: US 6,908,113 B2
(45) **Date of Patent: *Jun. 21, 2005**

(54) TAMPER-EVIDENT LABEL

(75) Inventors: Alain Chaduc, Loubeyrat (FR); Olivier Naudan, Perignat (FR)

(73) Assignee: Laboratories Merck Sharp and Dohme-Chibret, SNC, Paris (FR)

( * ) Notice: Subject to any disclaimer, the term of this patent is extended or adjusted under 35 U.S.C. 154(b) by 350 days.

This patent is subject to a terminal disclaimer.

(21) Appl. No.: 10/219,539

(22) Filed: Aug. 15, 2002

(65) Prior Publication Data

US 2003/0047937 A1 Mar. 13, 2003

Related U.S. Application Data

(60) Provisional application No. 60/312,624, filed on Aug. 18, 2001.

(51) Int. Cl.[7] ..... B42D 15/00

(52) U.S. Cl. ..... 283/81; 40/299.01; 40/306; 40/311; 40/630; 206/459.5; 206/460; 206/807; 283/103; 428/42.1; 428/43; D20/22

(58) Field of Search ..... 40/299.01, 306, 40/310, 311, 625, 626, 627, 628, 629, 630; 206/459.5, 460, 807; 283/81, 101, 103, 105; 428/40.1, 42.1, 42.2, 42.3, 43; D20/22

(56) References Cited

U.S. PATENT DOCUMENTS

| | | | | | |
|---|---|---|---|---|---|
| 3,983,645 | A | * | 10/1976 | Rycroft | 40/630 |
| 4,540,101 | A | * | 9/1985 | Kutcher | 215/252 |
| 4,640,427 | A | * | 2/1987 | Marino et al. | 215/232 |
| 5,048,711 | A | * | 9/1991 | Weiss et al. | 220/214 |
| 5,217,307 | A | * | 6/1993 | McClintock | 383/81 |
| 5,443,154 | A | * | 8/1995 | Hustad et al. | 206/213.1 |
| 5,495,944 | A | * | 3/1996 | Lermer | 206/459.1 |
| 5,727,819 | A | * | 3/1998 | Grosskopf et al. | 283/81 |
| D469,471 | S | * | 1/2003 | Chauduc et al. | D20/22 |

* cited by examiner

*Primary Examiner*—Monica Carter
(74) *Attorney, Agent, or Firm*—James M. Hunter, Jr.; Mark R. Daniel

(57) ABSTRACT

A tamper-evident label suitable for placement onto a container and cap assembly. The label may be characterized as a planar sheet having a tear strip that divides upper and lower panels. The lower panel of the label attaches to the container, while the upper panel, defined by at least one tab, and preferably two tabs, is attached to the cap. To open the container and cap assembly, the tear strip is pulled across the label to separate the two panels of the label. Thereafter, the cap may be removed from the container to reveal the contents of the container.

8 Claims, 3 Drawing Sheets

TAMPER-EVIDENT LABEL

This application claims the benefit of provisional application No. 60/312,624 filed Aug. 18, 2001.

FIELD OF THE INVENTION

The present invention is directed to a tamper-evident label suitable for placement on a container and cap assembly.

BACKGROUND OF THE INVENTION

Tamper-evident labels are useful for alerting consumers of products marketed in bottles and containers that the product might have been opened prior to sale thereof at the retail level. These labels have been placed on prescription and over-the-counter pharmaceutical products, cosmetics, alcoholic beverages, and the like.

When damaged, tamper-evident labels provide visible proof that a container and closure assembly has been tampered with or opened. Generally, this type of label will show signs of breakage or wrinkling when the closure is rotated relative to the container because relative fixed position of the container and cap has been changed from the position fixed by the manufacturer. The breakage or wrinkling of the label provides indication to a consumer that the product might have been opened prior to sale thereof. The prior art provides many aspects of tamper-evident and resistant labels.

U.S. Pat. No. 958,887 to Parmele teaches a sealed receptacle having a body and cover, wherein a label secured by adhesive material to both the body and cover. A series of 'bonds' cover the interface where the body and cover meet. The bonds are large circular-shaped perforations, wherein the interface can be seen there through.

U.S. Pat. No. 2,272,262 to Carter suggests a strip stamp useful for covering the mouth of the neck of a bottle and cap. After an adhesive is placed on the underside of the strip, the strip is attached over the cap and bottleneck.

U.S. Pat. No. 3,983,645 to Rycroft discloses a tamper-proof label adapted to be applied to joined surfaces of a thermoplastic member and heat-sealed in place. The label is cut in predetermined locations on each side of the adjoining surfaces, and contain indicia to identify a product in the thermoplastic member. Upon opening the thermoplastic member, the label is separated into two distinctive parts.

U.S. Pat. No. 4,450,101 to Kutcher discloses a container assembly including a tamper-indicating ban. The assembly is characterized as a container having a closure covering an opening of the container and includes a skirt, and a tamper-indicating band overlying the skirt. The band is characterized as an array of obliquely slanted score lines spaced apart from one another. Removal of the closure from the container by grasping the band and manually twisting breaks or visibly distorts at least one of the strips.

U.S. Pat. No. 4,640,427 to Marino et al discloses a tamper-resistant thermoplastic closure for containers such as bottles wherein the closure has a continuous thread pattern engagable on a matching continuous thread pattern on the container or snap-on fastening configuration, wherein a tab attaches to the container and the cap. The tab is characterized as having a tear-away portion so that when the container and cap are separated parts of the tab remains with the container and cap.

U.S. Pat. No. 5,048,711 to Weiss et al discloses a label indicator for a screw thread closure characterized as a label applied in an overlapping relation to the closure and container. The label has two areas that can be separated and alignment indicators on the two areas that are unaligned. In use, after the label has been applied, the closure is removed by unscrewing, breaking the label. Thereafter, when the closure is reapplied, the closure is overtightened to align the previously unaligned alignment indicators of the label to insure a leak-free container system after the closure has been reapplied.

U.S. Pat. No. 5,217,307 to McClintock discloses a tamper-safety label easily applicable to a container and closure means to disclose the opening of the container. The label is characterized as a face stock extending over a closure line between a container and a closure having a tear strip with a tab formed thereon to divide the stock into two parts so that when the strip is torn.

U.S. Pat. No. 5,495,944 to Lermer discloses a sealed tamper-evident label characterized as a bottle having a frangible label connected to the side wall portion of the bottle; a wrapper having an upper portion that overlies the cap and a lower portion that overlies the bottle and at least a portion of the label so that the cap is sealably fixed to the bottle. Removal of the wrapper lower portion ruptures the frangible label, wherein the rupture serves as visible indicia of the removal of the wrapper bottom portion form the bottle and alerts the consumer to possible tampering.

U.S. Pat. No. 5,727,819 to Grosskopf discloses a resealable laminated package label having a tamper-resistant feature. The invention may be further characterized as a multipanel information leaflet having a tab attached thereto. The leaflet is affixed to the bottom portion of a container and the tab is affixed to the top of a container and top assembly such that relative displacement between the container and cap results in displacement of the leaflet and tab.

While the prior art is replete with tamper-resistant and tamper-evident labels suitable for use on a variety of containers for pharmaceuticals, cosmetics, beverages, etc., there is a need for a tamper-evident label that is easily removable from a container by the consumer, and easily evident of tampering and opening after manufacture but prior to sale.

SUMMARY OF THE INVENTION

The present invention is directed to a tamper-evident label suitable for affixing a container and cap assembly, the cap being removably attached to the container, said container having a bottom, side walls, a mouth, and top edge adjacent to the mouth, said cap having a top, side wall, and bottom edge adjacent to the mount of the container, wherein a spacing void exists between the walls of the container and cap, the label being characterized as:

a) a planar sheet having a tear strip defined by two parallel perforated lines there through defining upper and lower panels, the tear strip overlaying the void between the container and cap assembly walls, extending over the top edge of the container and the bottom edge of the cap, said upper panel, being suitable for attachment to the cap, having at least two tabs extending over the side walls of said cap, said tear strip extending around the assembly and over said spacing void, and said lower panel, being suitable for attachment to the container, extending around said side walls of the container, and b) means for attaching the label to the container and cap assembly, wherein tampering with or removing said tear strip from the assembly by way of pulling an end tab, removing or repositioning the cap from the container causes the perforated lines of the tear strip to wrinkle or rupture separating the upper and lower panels of the assembly along the tear strip, wherein the tabs of the upper panel remain attached to the cap and the lower panel remains attached to the container, and wherein wrinkle or rupture of the label serves as visible and physical evidence of opening of said assembly.

BRIEF DESCRIPTION OF THE DRAWINGS

The tamper-evident label of the present invention will become more apparent from the ensuing description when considered together with the accompanying drawings wherein like reference numbers denote like components, wherein.

DETAILED DESCRIPTION OF THE INVENTION

The present invention is directed to a novel, tamper-evident label. That is, if the container and cap assembly to which the label is adhered is opened or has been tampered with, the label will show signs of wrinkling or breakage along the tear strip. The label is designed to fit at least about half way around the container and cap assembly to which it is adhered. The label may be better understood by reviewing the figures attached herewith.

Figure 1:
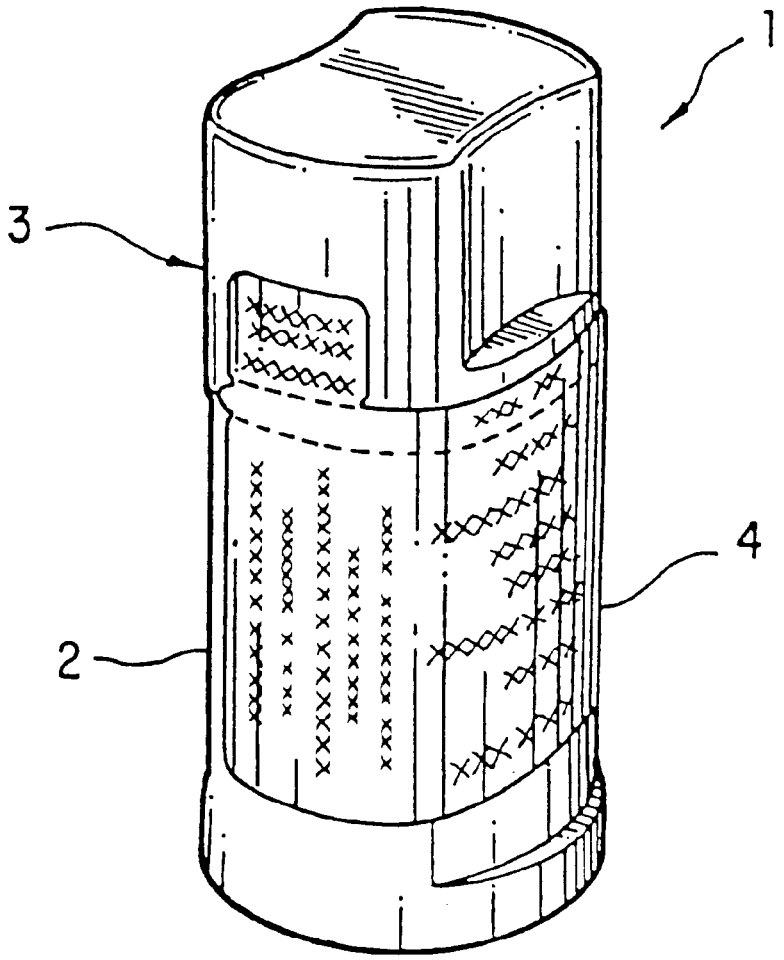
FIG. 1 is a perspective view in elevation of a container and cap assembly having the label of the invention attached thereto.

FIG. 1 provides a perspective view of a container and cap assembly typical for marketing pharmaceutical and over-the-counter products having the tamper-evident label of the present invention attached thereto. Container and cap assembly 1 is typically fabricated from thermoplastic, glass, metal, a combination thereof, and the like. Container 2, typically, exhibits a rectangular, polygon, elliptical or oval shape. Cap 3, typically, exhibits an identical or complimentary shape to the container, and will be have a twist- or screw-off design. Tamper-evident label 4, fabricated from thermoplastic, metal foil, paper, the like, and combinations thereof, raps around the container and cap assembly and is held thereto by an adhesive or other means known to those skilled in the art.

Figure 2:
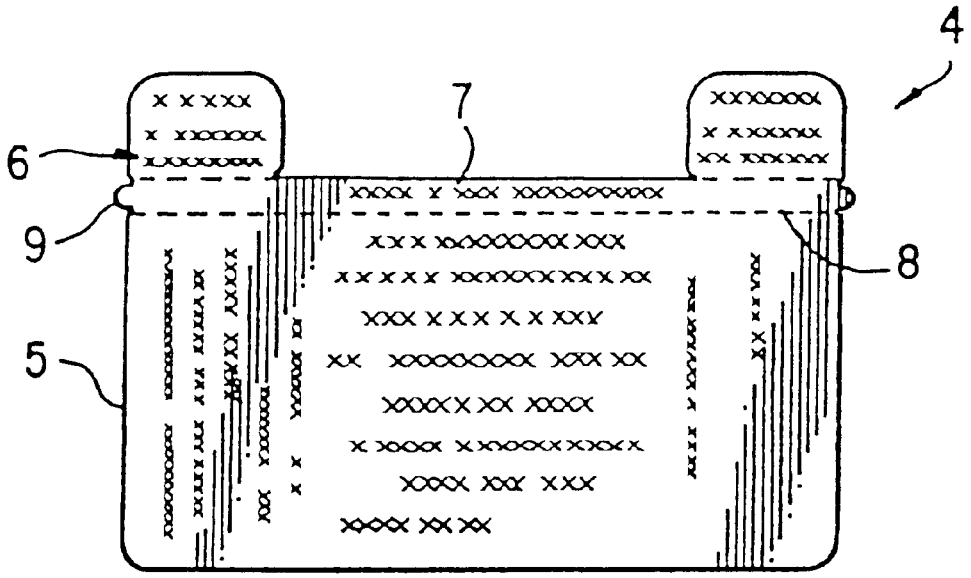
FIG. 2 is a front view in elevation of the flat label.

FIG. 2 provides a front view of flattened label 4 not attached to a container and cap assembly. Label 4 can be defined as having lower panel 5, attached to the container-portion of the assembly, and upper panel 6 is attached to the cap-portion of the assembly, wherein the two panels are divided by tear strip 7. Lower panel 5 and upper panel 6 are suitable for containing indicia of identification, use and safety instructions for the product contained within the assembly. Upper panel 6 can be further characterized as 1 or more tabs, typically, at least 2 tabs, and preferably, at least 2 opposing tabs when the label is attached to the container and cap assembly. The upper and lower panels of the label are separated by tear strip 7. Tear strip 7 is defined by two parallel, perforated lines 8 that divide the lower and upper panels. On opposite ends of tear strip 7 are pull-tabs 9.

Figure 3:
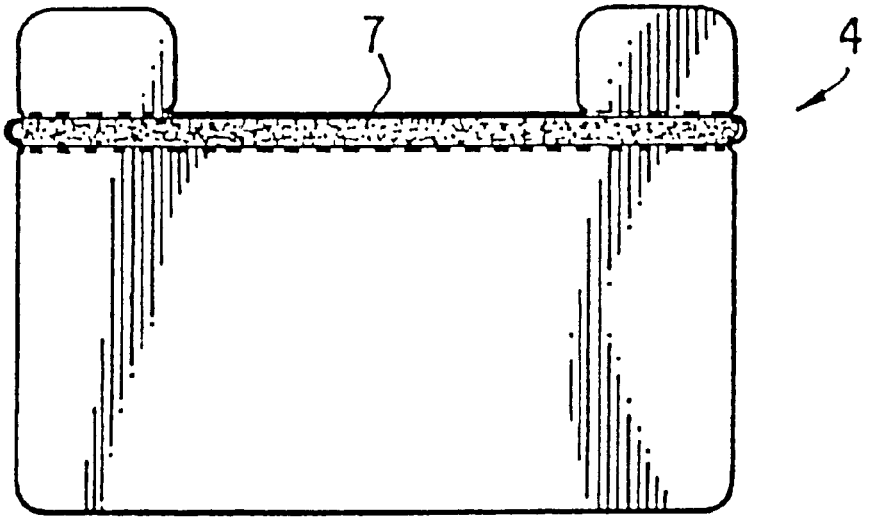
FIG. 3 is a back view in elevation of the flat label.

Referring to FIG. 3, there is illustrated the back of flatten label 4 (not attached to a container and cap assembly). Tear strip 7 typically contains reinforcement means such as a fibrous filament, plastic or metal strip, or other reinforcement means and/or theft detection material known in the art. The reinforcement means will typically attach to the strip and run from end to end of the strip, parallel between the perforations. The back of tear strip 7 may be of a contrasting color to the front of the strip. When tear strip 7 is removed from the label of tampered with, it breaks or wrinkles the perforated lines to separate the strip from the lower and upper panels of the label without the tear strip segmenting prior to complete removal thereof. The tear strip also evidence wrinkling when the relative position of the container and cap is changed between manufacture and sale, wherein tampering is visibly and physically evident. An adhesive means, generally consisting of glue may be placed on the back of the label for adhesion of the label to the container and cap assembly.

Figure 4:
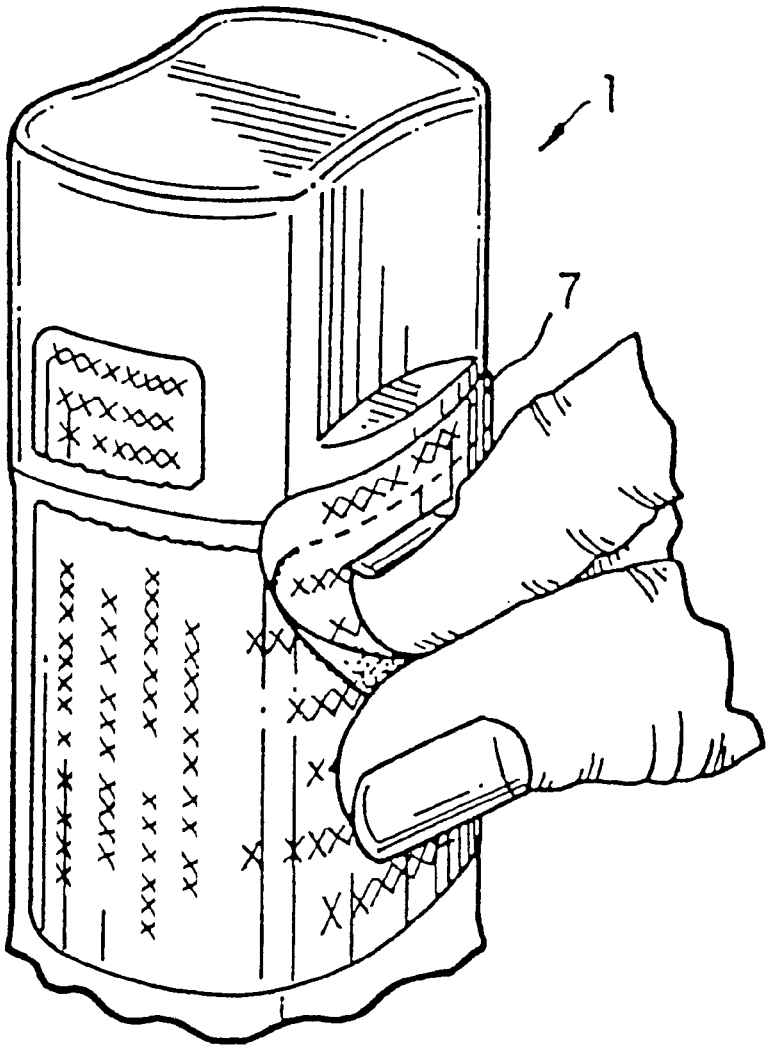
FIG. 4 is a perspective view in elevation of a container and cap assembly having the label of the invention attached thereto illustrating the tear strip being removed from the label.

FIG. 4 provides a perspective view of container and cap assembly 1 having label 4 attached thereto wherein tear strip 7 is being removed by a user. Grabbing the tear strip at pull-tab 9 (not shown), the user may remove the strip in one-piece by a continuous pulling thereof to expose the spacing void between the container and cap. Thereafter, the cap may be removed to expose the month of the container for release of the product within the container.

A preferred embodiment of the invention is directed to a tamper-evident label suitable for attaching to a glass, thermoplastic, metal and the like container and cap assemblies, wherein the cap being removably attached to the container, said container having a bottom, side walls, a mouth, and top edge adjacent to the mouth, said cap having a top, side wall, and bottom edge adjacent to the mount of the container, wherein a spacing void exists between the walls of the container and cap, the label characterized as:

a) a planar paper sheet having a tear strip defined by two parallel perforated lines there through defining upper and lower panels, the tear strip overlaying the void between the container and cap assembly walls, extending over the top edge of the container and the bottom edge of the cap, said tear strip having pull tabs on opposite ends thereof and a reinforcing strand incorporated therein, said upper panel, being suitable for attachment to the cap, having at least two tabs extending over the side walls of said cap, said tear strip extending around the assembly and over said spacing void, and said lower panel, being suitable for attachment to the container, extending around said side walls of the container, and b) adhesive means for attaching the label to the container and cap assembly, wherein tampering with or removing said tear strip from the assembly by way of pulling an end tab, removing or repositioning the cap from the container causes the perforated lines of the tear strip to wrinkle or rupture separating the upper and lower panels of the assembly along the tear strip, wherein the tabs of the upper panel remain attached to the cap and the lower panel remains attached to the container, and wherein wrinkle or rupture of the label serves as visible and physical evidence of opening of said assembly.

Although this invention has been described with respect to specific embodiments, the details of these embodiments are not to be construed as limitations. Various equivalents, changes and modifications may be made without departing from the spirit and scope of this invention, and it is understood that such equivalent embodiments are part of this invention.

What is claimed is:

1. A tamper-evident label suitable for attaching to a container and cap assembly, the cap being removably attached to the container, said container having a bottom, side walls, a mouth, and top edge adjacent to the mouth, said cap having a top, side wall, and bottom edge adjacent to the mount of the container, wherein a spacing void exists between the walls of the container and cap, the label comprising:

a) a planar sheet having a tear strip defined by two parallel perforated lines there through defining upper and lower panels, the tear strip overlaying the void between the assembly walls, extending over the top edge of the container and the bottom edge of the cap, said upper panel, being suitable for attachment to the cap, having at least two tabs extending over the side walls of said cap, said tear strip extending around the assembly and over said spacing void, and said lower panel, being suitable for attachment to the container, extending around said side walls of the container, and b) means for attaching the label to the container and cap assembly, wherein tampering with or removing said tear strip from the assembly by way of pulling an end tab, removing or repositioning the cap from the container causes the perforated lines of the tear strip to wrinkle or rupture separating the upper and lower panels of the assembly along the tear strip, wherein the tabs of the upper panel remain attached to the cap and the lower panel remains attached to the container, and wherein wrinkle or rupture of the label serves as visible and physical evidence of opening of said assembly.

2. The tamper-evident label according to claim 1, wherein the upper and lower panels containing identification, safety and use indicia.

3. The tamper-evident label according to claim 2, wherein the label is fabricated from a material selected from the group consisting of a thermoplastic material, metal foils and paper.

4. The tamper-evident label according to claim 3, wherein the tear strip contains a tab on either end thereof.

5. The tamper-evident label according to claim 4, wherein the tear strip contains reinforcement there through.

6. The tamper-evident label according to claim 5, wherein the reinforcement is selected from fibrous filaments, plastics and metal strips.

7. The tamper-evident label according to claim 6, wherein the fibrous filament is parallel to the perforations in the label.

8. A tamper-evident label suitable for attaching to a thermoplastic container and cap assembly, the cap being removably attached to the container, said container having a bottom, side walls, a mouth, and top edge adjacent to the mouth, said cap having a top, side wall, and bottom edge adjacent to the mount of the container, wherein a spacing void exists between the walls of the container and cap, the label comprising:

a) a planar paper sheet having a tear strip defined by two parallel perforated lines there through defining upper and lower panels, the tear strip overlaying the void between the assembly walls, extending over the top edge of the container and the bottom edge of the cap, said tear strip having pull tabs on opposite ends thereof and a reinforcing strand incorporated therein, said upper panel, being suitable for attachment to the cap, having at least two tabs extending over the side walls of said cap, said tear strip extending around the assembly and over said spacing void, and said lower panel, being suitable for attachment to the container, extending around said side walls of the container, and b) adhesive means for attaching the label to the container and cap assembly, wherein tampering with or removing said tear strip from the assembly by way of pulling an end tab, removing or repositioning the cap from the container causes the perforated lines of the tear strip to wrinkle or rupture separating the upper and lower panels of the assembly along the tear strip, wherein the tabs of the upper panel remain attached to the cap and the lower panel remains attached to the container, and wherein wrinkle or rupture of the label serves as visible and physical evidence of opening of said assembly.

* * * * *